US010968059B2

(12) United States Patent
Yamaguchi

(10) Patent No.: US 10,968,059 B2
(45) Date of Patent: Apr. 6, 2021

(54) SHEET STACKING DEVICE AND IMAGING FORMING APPARATUS PROVIDED WITH SAME

(71) Applicant: KYOCERA Document Solutions Inc., Osaka (JP)

(72) Inventor: Yoshihiro Yamaguchi, Osaka (JP)

(73) Assignee: KYOCERA Document Solutions Inc.

( * ) Notice: Subject to any disclaimer, the term of this patent is extended or adjusted under 35 U.S.C. 154(b) by 336 days.

(21) Appl. No.: 15/170,165

(22) Filed: Jun. 1, 2016

(65) Prior Publication Data

US 2016/0362264 A1 Dec. 15, 2016

(30) Foreign Application Priority Data

Jun. 15, 2015 (JP) ..... JP2015-120295

(51) Int. Cl.
*B65H 1/04* (2006.01)
*B65H 1/14* (2006.01)
*B65H 1/26* (2006.01)

(52) U.S. Cl.
CPC ..... *B65H 1/04* (2013.01); *B65H 1/14* (2013.01); *B65H 1/266* (2013.01);
(Continued)

(58) Field of Classification Search
CPC . B65H 1/266; B65H 1/08; B65H 1/12; B65H 1/14; B65H 2405/10; B65H 2405/11; B65H 2405/112; B65H 2405/113; B65H 2405/15; B65H 2405/31; B65H 2405/32; B65H 2407/22; B65H 2301/363;
(Continued)

(56) References Cited

U.S. PATENT DOCUMENTS 4,358,102 A * 11/1982 Hoshizaki ..... B65H 1/04 271/126
4,504,053 A * 3/1985 Shiozawa ..... B65H 1/14 271/157
(Continued)

FOREIGN PATENT DOCUMENTS

JP S57131643 A 8/1982
JP 59190125 A * 10/1984 ..... B65H 1/04
(Continued)

OTHER PUBLICATIONS

Japanese Office Action dated Dec. 20, 2017.

*Primary Examiner* — Howard J Sanders
(74) *Attorney, Agent, or Firm* — Gerald E. Hespos; Michael J. Porco; Matthew T. Hespos

(57) ABSTRACT

A sheet stacking device includes a sheet accommodating unit, a pair of wall portions and a loading plate. The sheet accommodating unit has an open upper surface part and accommodates sheets therein. The sheets have a pair of first side edges extending in a first direction and a pair of second side edges perpendicular to the first direction. The pair of wall portions stands to face the first side edges of the sheets. The loading plate is arranged in the sheet accommodating unit. Each of the pair of wall portions includes a first observation port for exposing one end of the first side edges of the sheets in the first direction and an one area of the inner part outer than the one end in the first direction to outside of the sheet accommodating unit.

10 Claims, 9 Drawing Sheets

(52) U.S. Cl.
CPC .... *B65H 2405/114* (2013.01); *B65H 2405/15* (2013.01); *B65H 2407/22* (2013.01); *B65H 2511/522* (2013.01); *B65H 2601/2531* (2013.01)

(58) Field of Classification Search
CPC .... B65H 2301/422548; B65H 2401/22; B65H 2401/221; B65H 2401/223; B65H 2511/16; B65H 2511/416; B65H 2511/417; B65H 2511/522; B65H 2601/2531
See application file for complete search history.

(56) References Cited

U.S. PATENT DOCUMENTS

| | | | | |
|---|---|---|---|---|
| 4,765,605 | A * | 8/1988 | Abbott | B65H 1/12 271/127 |
| 5,629,672 | A * | 5/1997 | Brown | B65H 1/266 340/540 |
| 6,390,701 | B2 * | 5/2002 | Osmus | B41J 13/103 400/624 |
| 7,832,720 | B2 * | 11/2010 | Fujita | B65H 1/14 271/155 |
| 8,342,513 | B2 * | 1/2013 | Yamaguchi | B65H 1/14 271/126 |
| 8,783,677 | B2 * | 7/2014 | Matsushima | B65H 1/14 271/147 |
| 9,199,809 | B2 * | 12/2015 | Hamasaki | B65H 7/06 |
| 9,475,662 | B2 * | 10/2016 | Tanaka | B65H 1/00 |
| 9,637,332 | B2 * | 5/2017 | Tanaka | G03G 15/6502 |
| 2003/0113148 | A1 | 6/2003 | Hoene | |

FOREIGN PATENT DOCUMENTS

| | | |
|---|---|---|
| JP | 7-206217 | 8/1995 |
| JP | 2007191264 A | 8/2007 |

* cited by examiner

SHEET STACKING DEVICE AND IMAGING FORMING APPARATUS PROVIDED WITH SAME

This application is based on Japanese Patent Application No. 2015-120295 filed with the Japan Patent Office on Jun. 15, 2015, the contents of which are hereby incorporated by reference.

BACKGROUND

The present disclosure relates to a sheet stacking device on which sheets are to be stacked, and an image forming apparatus provided with the same.

Conventionally, a sheet stacking device provided in an image forming apparatus is known as a sheet stacking device on which sheets are to be stacked. Further, a large-capacity deck is known which is coupled to an apparatus main body of an image forming apparatus and configured such that sheets are stacked and accommodated inside.

In the large-capacity deck as described above, a user inserts a sheet bundle into the deck from above.

SUMMARY

A sheet stacking device according to one aspect of the present disclosure includes a sheet accommodating unit, a pair of wall portions and a loading plate. The sheet accommodating unit has an open upper surface part and accommodates sheet therein through the upper surface part. The sheets have a pair of first side edges extending in a first direction and a pair of second side edges extending in a second direction perpendicular to the first direction. The pair of wall portions stands to face the pair of the first side edges of the sheets. The loading plate is arranged in the sheet accommodating unit and has an upper surface on which the sheet bundle is placed. Each of the pair of wall portions includes a first observation port for allowing an inner part of the sheet accommodating unit to be visible from outside of the sheet accommodating unit and for exposing one end of the first side edges of the sheets in the first direction and an one area of the inner part outer than the one end in the first direction to the outside of the sheet accommodating unit.

Further, an image forming apparatus according to another aspect of the present disclosure includes the above sheet stacking device, a feeding unit and an image forming unit. The feeding unit feeds the sheet accommodated in the sheet accommodating unit. The image forming unit forms an image on the sheet fed by the feeding unit.

DETAILED DESCRIPTION

Figure 1:
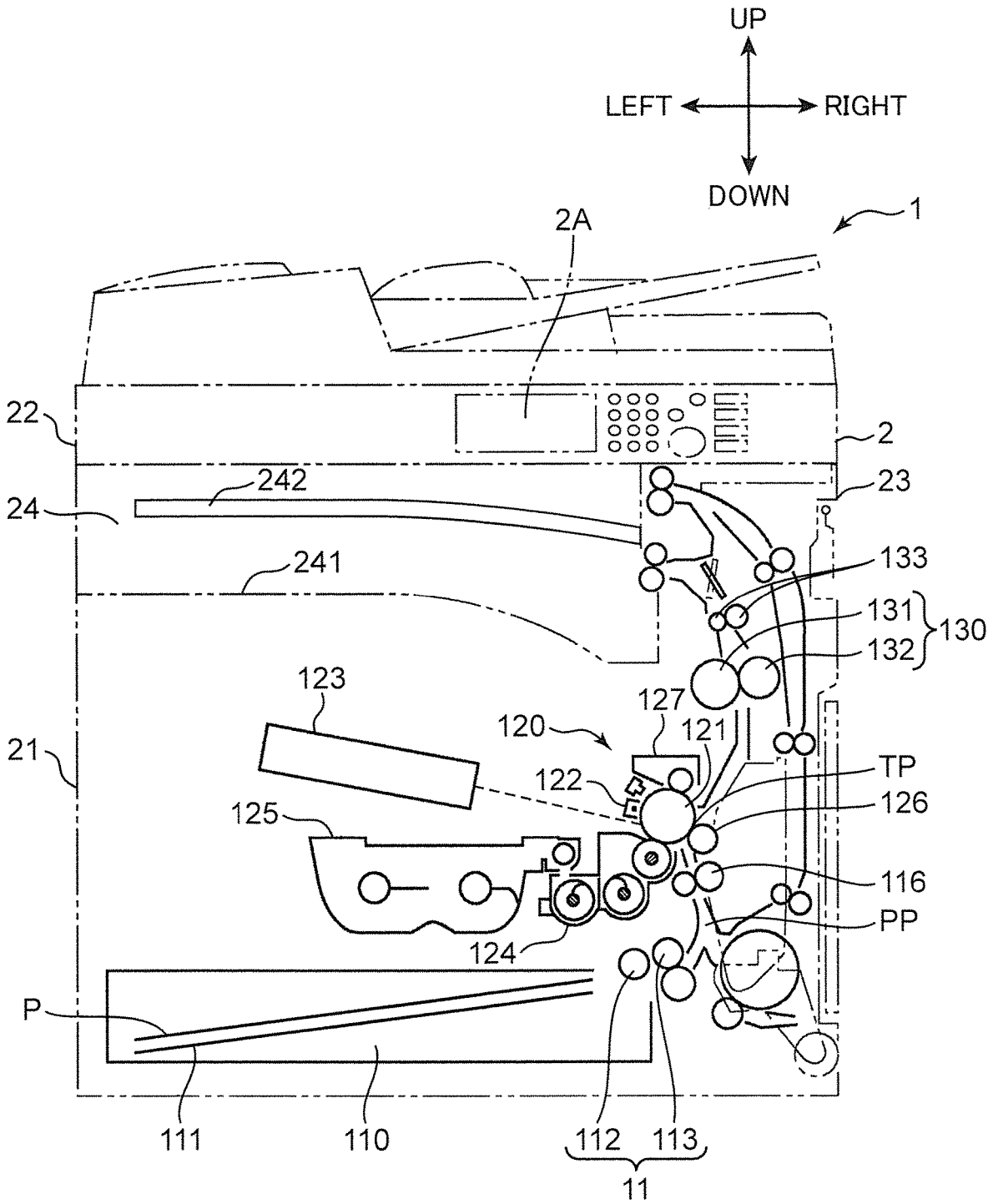
FIG. 1 is a sectional view of an image forming apparatus according to an embodiment of the present disclosure.

Hereinafter, one embodiment of the present disclosure is described with reference to the drawings. FIG. 1 is a sectional view of an image forming apparatus 1 according to the one embodiment of the present disclosure. The image forming apparatus 1 shown in FIG. 1 is a so-called monochrome printer. In other embodiments, the image forming apparatus may be a color printer, a facsimile machine, a complex machine provided with these functions or another apparatus for forming a toner image on a sheet. Note that direction-indicating terms such as "upper" and "lower", "front" and "back", "left" and "right" used in the following description are merely for the purpose of clarifying the description and do not limit the principle of the image forming apparatus at all. Further, in the following description, a term "sheet" means a copy sheet, a coated paper, an OHP sheet, a cardboard, a postcard, a tracing paper or another sheet material to which an image forming process is to be applied or another sheet material to which an arbitrary process other than the image forming process is to be applied.

The image forming apparatus 1 includes a substantially rectangular parallelepipedic main housing 2. The main housing 2 includes a substantially rectangular parallelepipedic lower housing 21, a substantially rectangular parallelepipedic upper housing 22 arranged above the lower housing 21 and a coupling housing 23 coupling the lower housing 21 and the upper housing 22. The coupling housing 23 extends along the right edge and the back edge of the main housing 2. A sheet having a printing process applied thereto is discharged to a discharge space 24 enclosed by the lower housing 21, the upper housing 22 and the coupling housing 23. Particularly, in this embodiment, sheets are discharged to a sheet discharging portion 241 arranged on an upper surface part of the lower housing 21 and to a sheet discharge tray 242 arranged above the sheet discharging portion 241. An electronic circuit for mainly controlling devices for reading an image of a document and the entire image forming apparatus 1 is housed in the upper housing 22.

The image forming apparatus 1 includes a sheet cassette 110, a sheet feeding unit 11, a pair of registration rollers 116 and an image forming unit 120. The sheet feeding unit 11 includes a pickup roller 112 and a sheet feed roller 113. The sheet feeding unit 11 feeds a sheet P in a rightward direction from the sheet cassette 110 toward a sheet conveyance path PP. The sheet conveyance path PP is a conveyance path arranged to extend from the sheet feeding unit 11 and pass through a transfer position TP arranged in the image forming unit 120 via the pair of registration rollers 116.

Sheets P are stacked in the sheet cassette 110. The cassette 110 can be pulled out in a forward direction (direction forward of the plane of FIG. 1) from the lower housing 21. The cassette 110 includes a body lift plate 111 for supporting the sheets P. The body lift plate 111 is inclined to push up the leading edges of the sheets P. The pickup roller 112 is rotated to feed the sheet P from the sheet cassette 110. The sheet feed roller 113 feeds the sheet P to a further downstream side in a sheet conveying direction. The pair of registration rollers 116 specify the position of the sheet in a direction perpendicular to the sheet conveying direction. The pair of registration rollers 116 convey the sheet P to the image forming unit 120 in accordance with a transfer timing of a toner image to the sheet P.

The image forming unit 120 includes a photoconductive drum 121, a charger 122, an exposure device 123, a developing device 124, a toner container 125, a transfer roller 126 and a cleaning device 127.

The transfer roller 126 is arranged to face the circumferential surface of the photoconductive drum 121 at the transfer position TP. At the transfer position TP, a toner image formed on the circumferential surface of the photoconductive drum 121 is transferred to the sheet P.

The image forming apparatus 1 further includes the fixing device 130 arranged downstream of the image forming unit 120 in the conveying direction and configured to fix a toner image on a sheet P. The fixing device 130 includes a heating roller 131 for melting toner on the sheet P and a pressure roller 132 for bringing the sheet P into close contact with the heating roller 131. When the sheet P passes between the heating roller 131 and the pressure roller 132, the toner image is fixed to the sheet P.

The image forming apparatus 1 further includes a pair of conveyor rollers 133 arranged downstream of the fixing device 130. The pair of conveyor rollers 133 convey the sheet P having a fixing process applied thereto by the fixing device 130 to a downstream side in the sheet conveying direction. The sheet P is discharged to the sheet discharging portion 241 or the sheet discharge tray 242.

Figure 2:
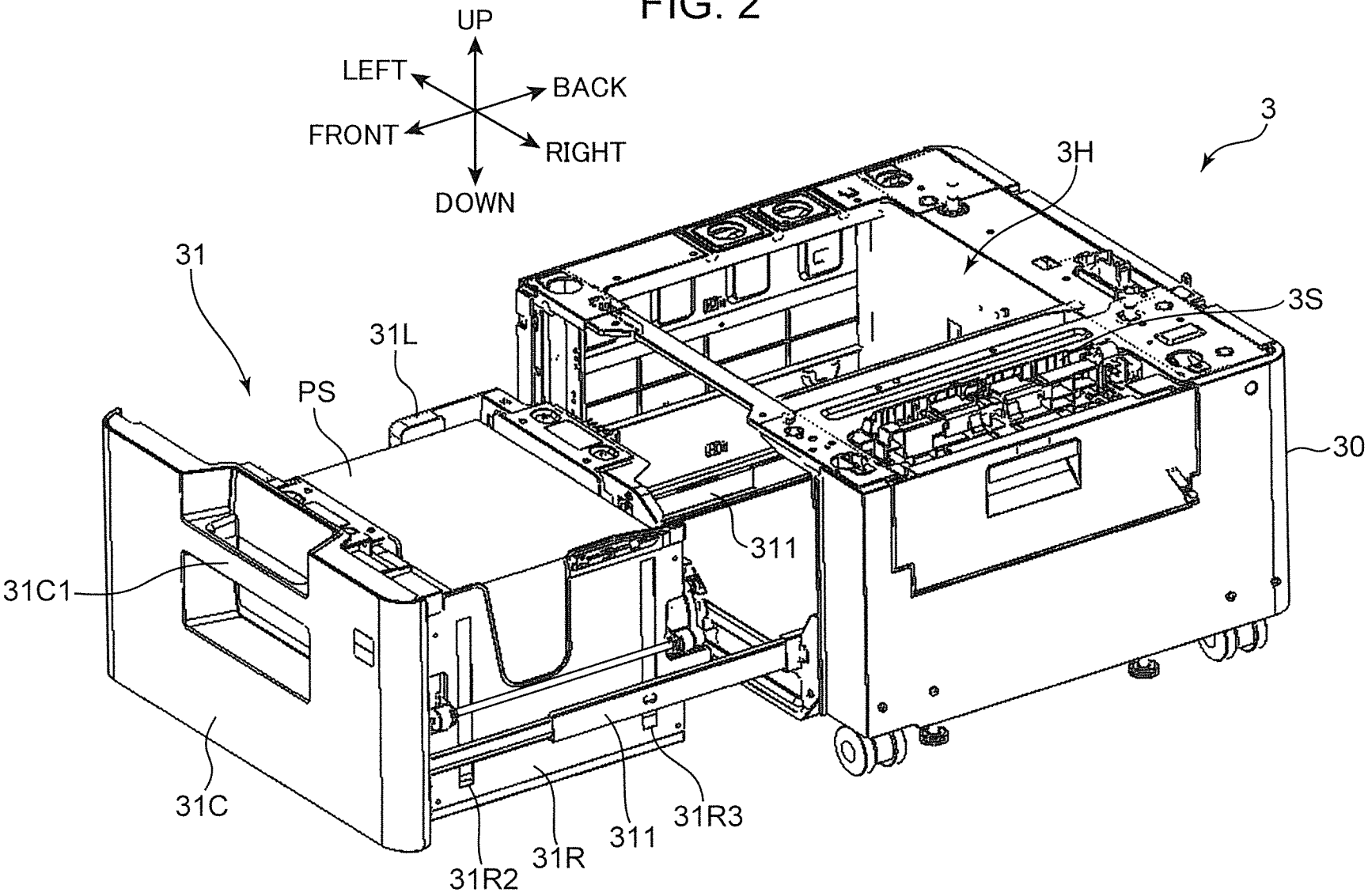
FIG. 2 is a perspective view of a sheet stacking device according to the embodiment of the present disclosure.
Figure 3:
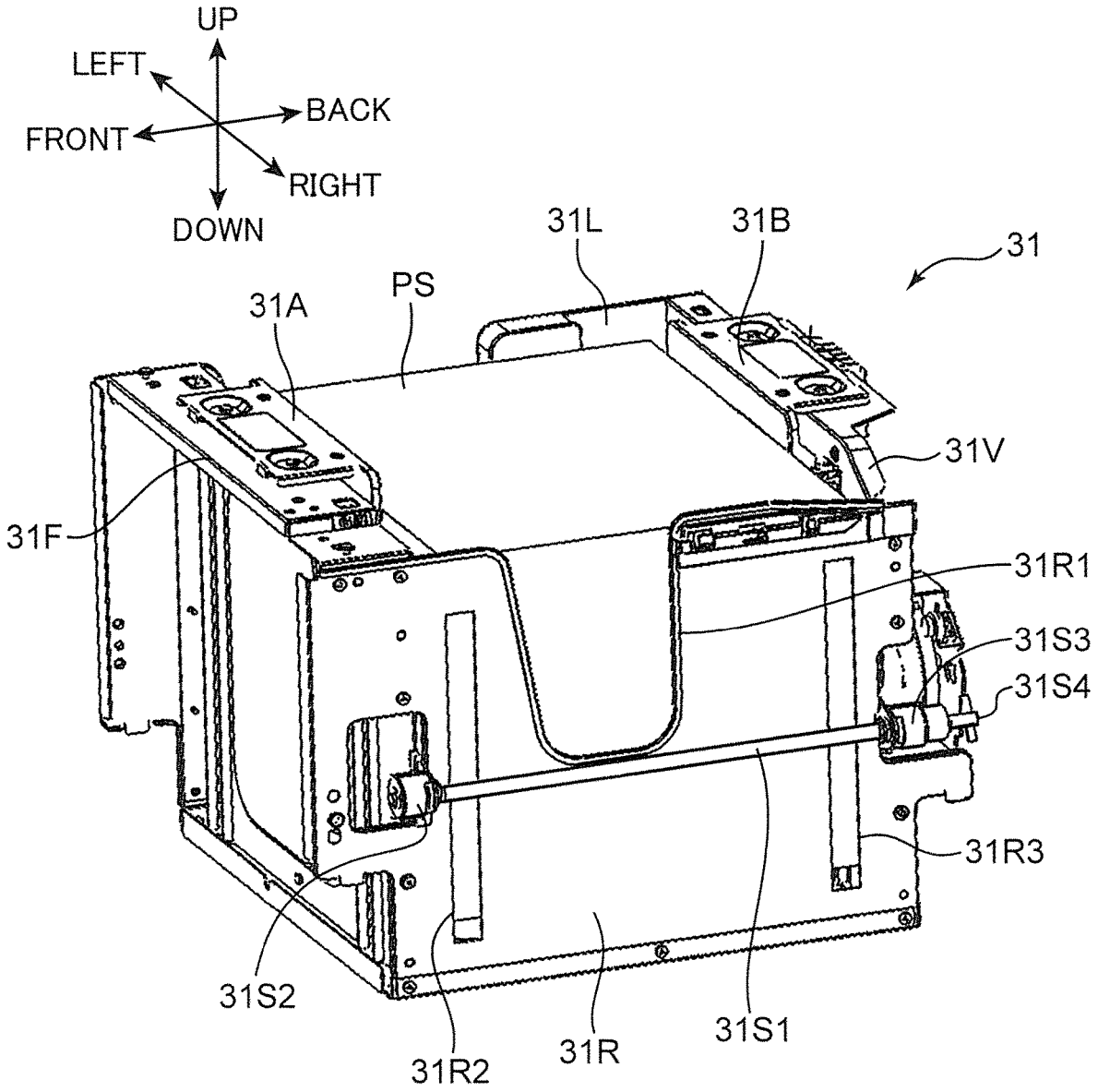
FIG. 3 is a perspective view of a sheet accommodating unit of the sheet stacking device according to the embodiment of the present disclosure.
Figure 4:
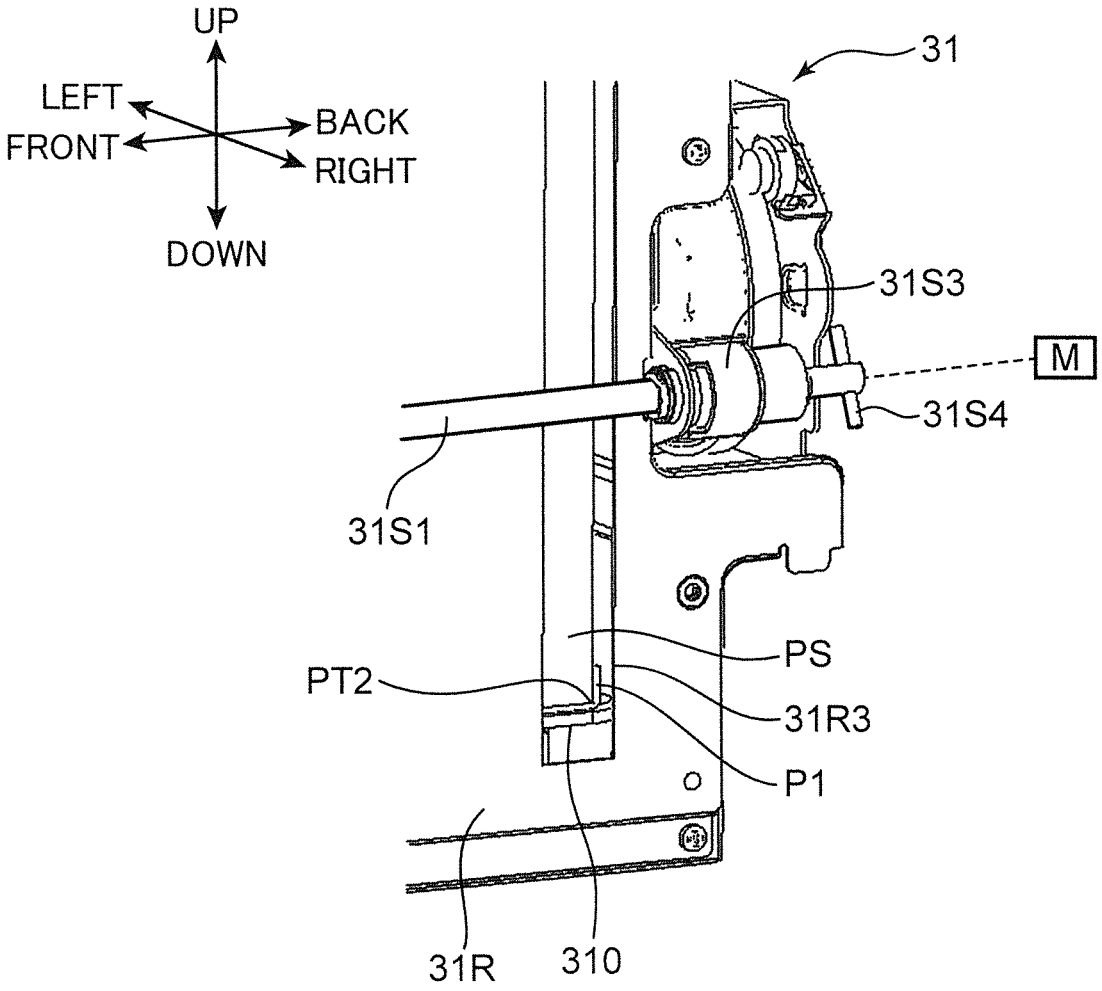
FIG. 4 is an enlarged perspective view enlargedly showing a part of the sheet accommodating unit of FIG. 3.
Figure 5:
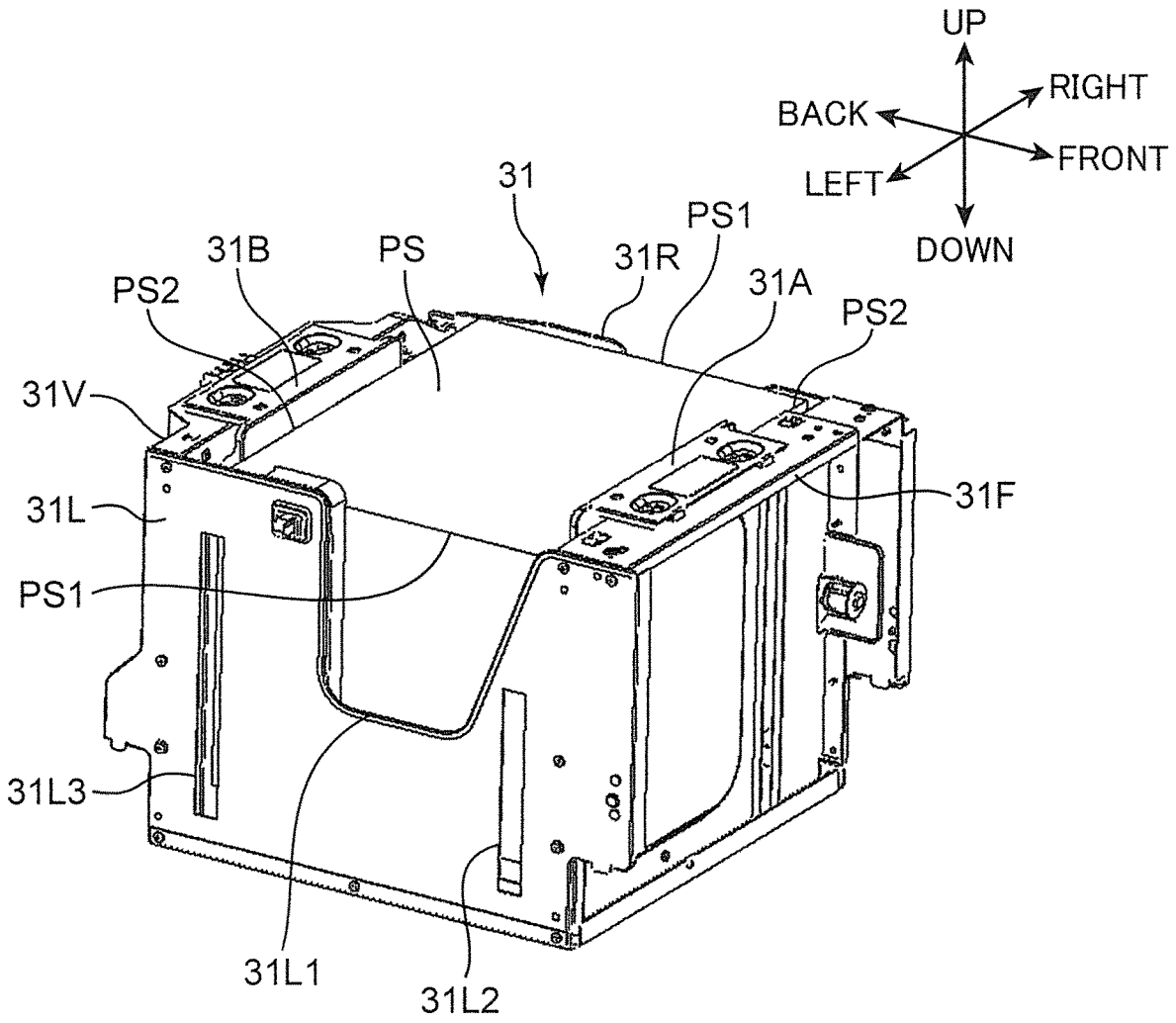
FIG. 5 is a perspective view of the sheet accommodating unit of the sheet stacking device according to the embodiment of the present disclosure.

Next, a sheet stacking device 3 according to this embodiment is described with reference to FIGS. 2 to 5. FIG. 2 is a perspective view of a sheet deck 3 (sheet stacking device) according to this embodiment. FIG. 3 is a perspective view of a deck tray 31 (sheet accommodating unit) of the sheet deck 3. FIG. 4 is an enlarged perspective view enlargedly showing a part of the deck tray 31. FIG. 5 is a perspective view of the deck tray 31 of the sheet deck 3.

With reference to FIG. 2, the sheet deck 3 stores a sheet bundle PS inside. The sheet deck 3 is mountable into a lower part of the aforementioned image forming apparatus 1. The sheet deck 3 includes a deck main body 30 (housing) and the deck tray 31 (sheet accommodating unit). The deck main body 30 is a housing part of the sheet deck 3. The deck main body 30 has a substantially rectangular parallelepipedic shape and a part of an upper surface part and a front surface part are open as shown in FIGS. 2 and 3. A tray housing portion 3H (FIG. 2) is formed in the deck main body 30. The deck tray 31 is arranged in the tray housing portion 3H of the deck main body 30. The deck tray 31 can be pulled out forward (along a first direction to be described later) from the deck main body 30. The sheet bundle PS is accommodated in the deck tray 31. The deck tray 31 is slid forward and backward along a pair of rail portions 311 (FIG. 2).

The deck main body 30 includes a sheet discharging unit 3S (feeding unit). The sheet discharging unit 3S is arranged on a right side part of the upper surface part of the deck main body 30 and feeds the sheet in the deck tray 31 toward the sheet conveyance path PP of the image forming apparatus 1. Note that the main housing 2 of the image forming apparatus 1 includes an unillustrated opening for receiving the sheet from the sheet deck 3.

The deck tray 31 has a substantially rectangular parallelepipedic box shape with an open upper surface part. The sheet bundle PS is accommodated into the deck tray 31 via the upper surface part of the deck tray 31. The deck tray 31 includes a front cover 31C, a lift plate 310 (loading plate) (FIG. 4), a right frame 31R (wall portion), a left frame 31L (wall portion), a front frame 31F (FIG. 3), a rear frame 31V, a front regulating portion 31A and a rear regulating portion 31B.

The front cover 31C is a plate-like cover member mounted on a front surface part of the deck tray 31. When the deck tray 31 is mounted into the deck main body 30, the front cover 31C defines the front surface part of the sheet deck 3. The front cover 31C includes a grip portion 31C1. The grip portion 31C1 is gripped by a user when the deck tray 31 is pulled out.

The lift plate 310 is a plate-like member arranged along a horizontal direction in the deck tray 31. The sheet bundle PS is placed on the upper surface of the lift plate 310. The lift plate 310 is vertically movable according to the rotation of a shaft 31S1 to be described later.

The right frame 31R is a wall portion standing on the right side of the deck tray 31. The right frame 31R includes a right cut portion 31R1 (cut portion), a first window portion 31R2 (second observation port) and a second window portion 31R3 (first observation port) (FIG. 3). The right cut portion 31R1 is cut downwardly from a substantially central part of the upper end edge of the right frame 31R in a front-back direction. The interior of the deck tray 31 is made easily visually confirmed from the outside of the deck tray 31 by the right cut portion 31R1. In the present embodiment, the right cut portion 31R1 is cut into a trapezoidal shape up to a substantially central part of the right frame 31R in a height direction.

The first window portion 31R2 is a long and narrow opening extending in a vertical direction on a front end side of the right frame 31R. The second window portion 31R3 is a long and narrow opening extending in the vertical direction on a rear end part of the right frame 31R.

The left frame 31L (FIG. 5) is a wall portion standing on the left side of the deck tray 31. The left frame 31L includes a left cut portion 31L1 (cut portion), a third window portion 31L2 (FIG. 5) (second observation port) and a fourth window portion 31L3 (FIG. 5) (first observation port). The left cut portion 31L1 is cut downwardly from a substantially central part of the upper end edge of the left frame 31L in the front-back direction. The interior of the deck tray 31 is made easily visually confirmed from the outside of the deck tray 31 by the left cut portion 31L1. In the present embodiment, the left cut portion 31L1 is also cut into a trapezoidal shape up to a substantially central part of the left frame 31L in the height direction similarly to the right cut portion 31R1.

The third window portion 31L2 is a long and narrow opening extending in the vertical direction on a front end side of the left frame 31L. The fourth window portion 31L3 is a long and narrow opening extending in the vertical direction on a rear end part of the left frame 31L.

The front frame 31F is a frame coupling the right frame 31R and the left frame 31L in a front part. The aforementioned front cover 31C is fixed to the front frame 31F.

Similarly, the rear frame 31V is a frame coupling the right frame 31R and the left frame 31L in a rear part.

The front regulating portion 31A is a plate-like member fixed to the front frame 31F. The front regulating portion 31A regulates the position of the front end edge of the sheet bundle PS accommodated in the deck tray 31. Similarly, the rear regulating portion 31B is a plate-like member fixed to the rear frame 31V. The rear regulating portion 31B regulates the position of the rear end edge of the sheet bundle PS accommodated in the deck tray 31. Note that the positions of the front regulating portion 31A and the rear regulating portion 31B can be changed along the front-back direction according to the size of sheets to be accommodated into the deck tray 31.

Further, the deck tray 31 includes the shaft 31S1, a front winding portion 31S2, a rear winding portion 31S3 and a drive transmitter 31S4 (FIG. 3). The shaft 31S1 extends in the front-back direction in a vertical central part of the right frame 31R. The shaft 31S1 is rotatably supported on the right frame 31R. The front and rear winding portions 31S2, 31S3 are respectively arranged before and behind the shaft 31S1. The front and rear winding portions 31S2, 31S3 wind an unillustrated wire fixed to the lift plate 310. The drive transmitter 31S4 is arranged on a rear end part of the shaft 31S1.

When the deck tray 31 is mounted into the deck main body 30, a motor M (FIG. 4) provided in the deck main body 30 is coupled to the drive transmitter 31S4. When the shaft 31S1 is rotated by a rotational drive force generated by the motor, the lift plate 310 is elevated. As a result, the sheet can be constantly supplied to the upper surface part of the deck tray 31. Note that since the drive transmitter 31 S4 and the motor are decoupled when the deck tray 31 is pulled out from the deck main body 30, the lift plate 310 moves downward. However, a biasing spring 310S (FIG. 7A) is arranged between the lift plate 310 and a bottom part of the deck tray 31. The lift plate 310 is arranged above the bottom part of the deck tray 31 by a predetermined height by a biasing force of the biasing spring 310S. Thus, the sheet bundle PS is easily accommodated when the user accommodates the sheet bundle PS into the deck tray 31. Note that the lift plate 310 is arranged below the lower end edges of the right and left cut portions 31R1, 31L1 by a predetermined height by the biasing force of the biasing spring 310S.

Note that, out of each sheet constituting the sheet bundle PS to be accommodated into the deck tray 31, a pair of end edges extending in the front-back direction (first direction) are defined as first side edges PS1 (FIG. 5). Further, a pair of end edges of the sheet extending in a lateral direction (second direction) are defined as second side edges PS2 (FIG. 5). The aforementioned right frame 31R and left frame 31L are arranged to face the first side edges PS of the sheets and the front frame 31F and the rear frame 31V are arranged to face the second side edges PS2 of the sheets.

Figure 6A:
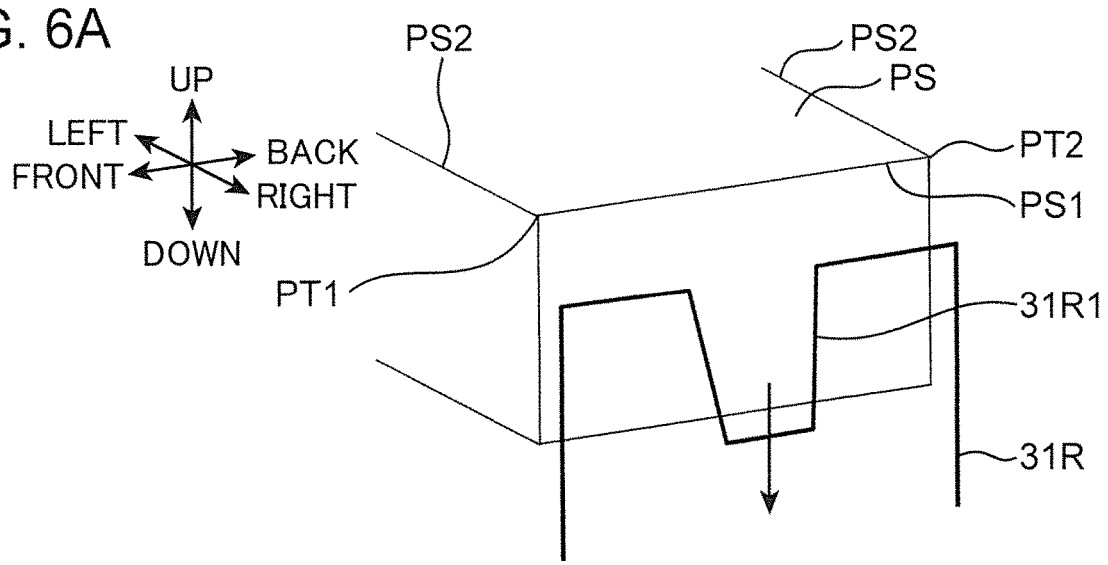
FIG. 6A is a schematic perspective view showing a state where a sheet bundle is being accommodated into the sheet accommodating unit.
Figure 6B:
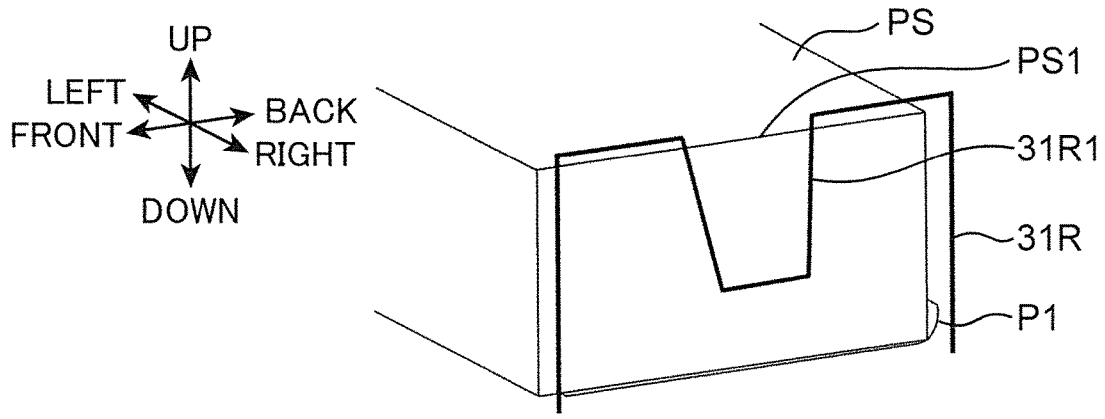
FIG. 6B is a schematic perspective view showing a state where the sheet bundle is accommodated in the sheet accommodating unit.
Figure 6C:
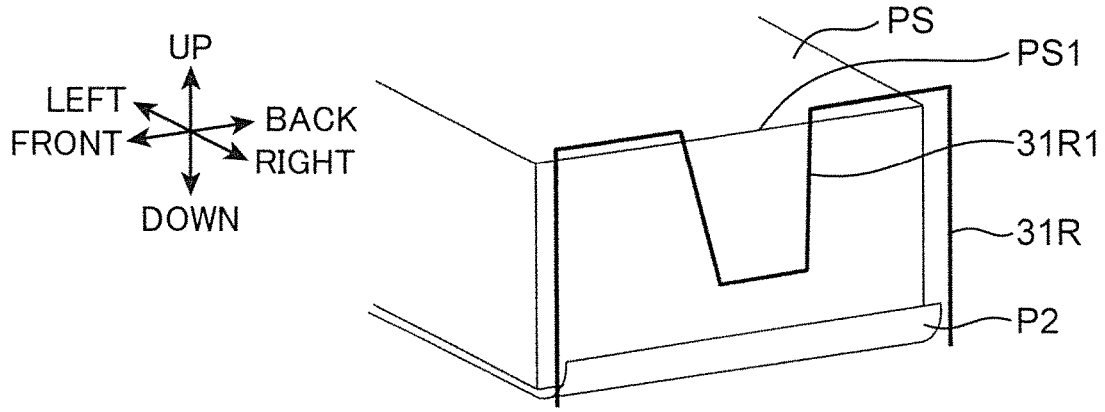
FIG. 6C is a schematic perspective view showing a state where the sheet bundle is accommodated in the sheet accommodating unit.
Figure 7A:
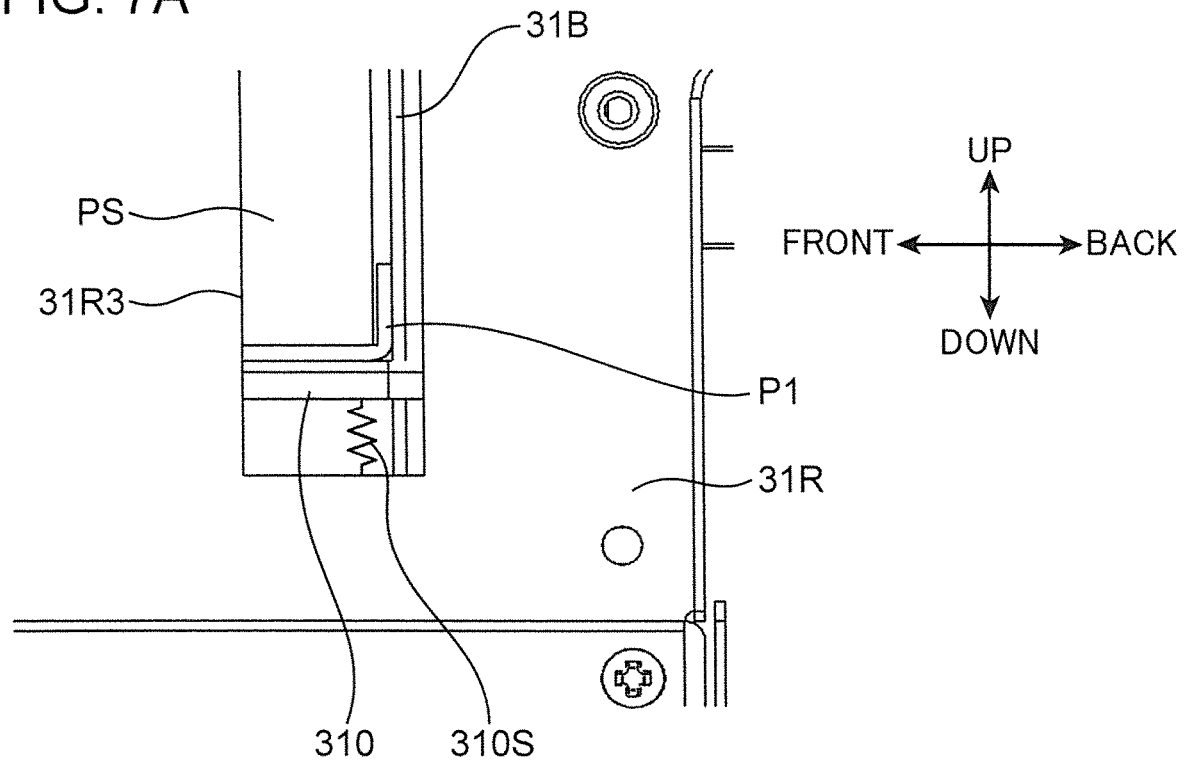
FIG. 7A is a side view showing the periphery of a first observation port in the state of FIG. 6B.
Figure 7B:
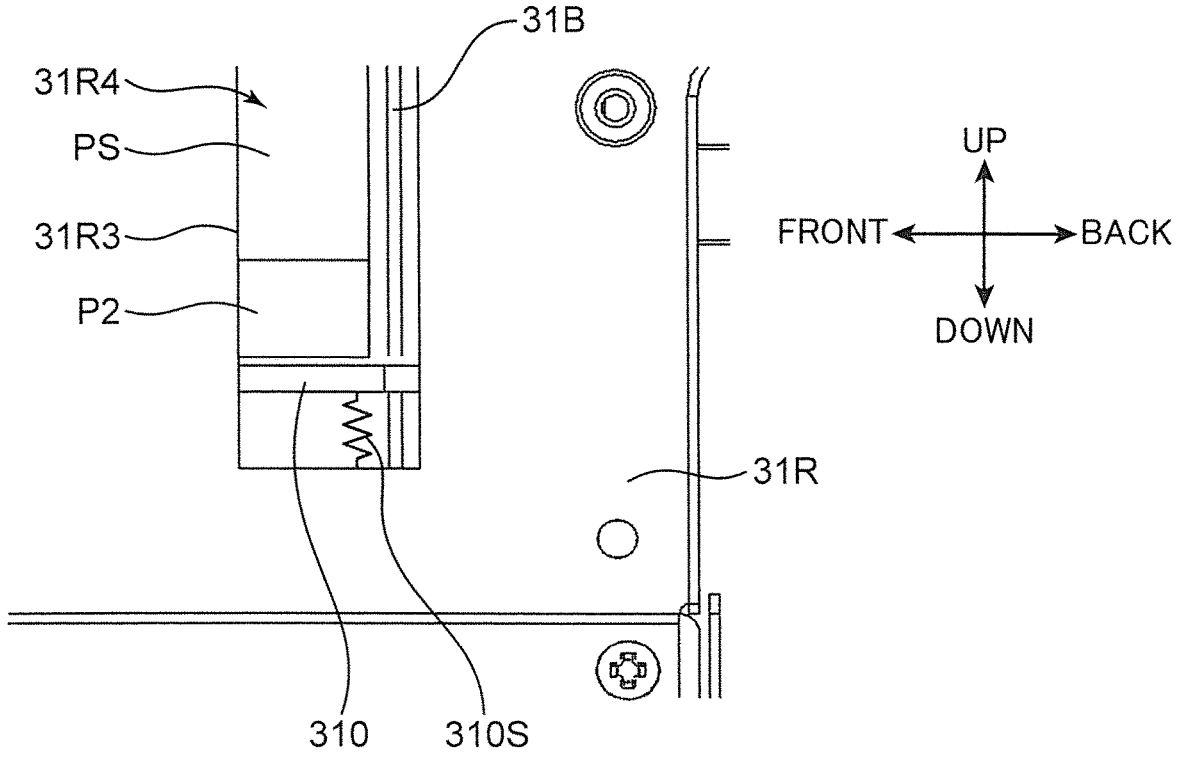
FIG. 7B is a side view showing the periphery of the first observation port in the state of FIG. 6C.

FIG. 6A is a schematic perspective view showing a state where the sheet bundle PS is being accommodated into the deck tray 31. FIGS. 6B and 6C are respectively schematic perspective views showing a state where the sheet bundle PS is accommodated in the deck tray 31. FIG. 7A is a side view showing the periphery of the second window portion 31R3 in the state of FIG. 6B. FIG. 7B is a side view showing the periphery of the second window portion 31R3 in the state of FIG. 6C.

When the sheets in the deck tray 31 are emptied, sheet empty information is displayed on a display unit 2A (FIG. 1) of the image forming apparatus 1. As shown in FIG. 2, the user pulls out the deck tray 31 forward from the deck main body 30. At this time, as described above, the lift plate 310 is arranged above the bottom part of the deck tray 31 and below the lower end edges of the left and right cut portions 31L1, 31R1.

As an example, when supplying the sheet bundle PS in which 500 or more sheets are stacked, the user holds lower end parts of the left and right side edges PS1 of the sheet bundle PS with both hands. The sheet bundle PS is so inserted through the upper surface part of the deck tray 31 that the both hands enter the right and left cut portions 31R1, 31L1. Eventually, the user releases the both hands from the sheet bundle PS and lets the sheet bundle PS to fall, whereby the sheet bundle PS is supplied into the deck tray 31. In this way, the user can smoothly accommodate the sheet bundle PS into the deck tray 31 using the left and right cut portions 31L1, 31R1. However, if the side edges of the sheets located in a lower end part of the sheet bundle PS come into contact with any of the right frame 31R, the left frame 31L, the front frame 31F and the rear frame 31V, the sheet bundle PS is likely to be accommodated into the deck tray 31 with the positions of the sheets displaced.

In FIG. 6B, the sheet bundle PS is accommodated with a sheet P1 located in the lower end part of the sheet bundle PS displaced backward. On the other hand, in FIG. 6C, the sheet bundle PS is accommodated with a sheet P2 located in the lower end part of the sheet bundle PS displaced rightward. Note that if the sheets in the lower end part stick to the hands of the user at the moment in which the user releases the hands from the sheet bundle PS, the state as shown in FIGS. 6C and 7B is easily reached. As just described, it is difficult to feed the sheet by the sheet discharging unit 3S (FIG. 2) and a sheet jam occurs if the sheet is partly displaced and one end edge is bent.

To solve such a problem, the aforementioned first, second, third and fourth window portions 31R2, 31R3, 31L2 and 31L3 are provided in this embodiment. If the sheet P1 is arranged in the state as in FIG. 6B, the bend of the sheet P1 can be visually confirmed at the second window portion 31R3 by the user as shown in FIG. 7A. Similarly, if the sheet P2 is arranged in the state as in FIG. 6C, the bend of the sheet P2 can be visually confirmed at the second window portion 31R3 by the user as shown in FIG. 7B. Thus, a sheet jam can be prevented by the user inserting the sheet bundle PS again or adjusting the position of the sheet when the number of the remaining sheets becomes small. Particularly, if the sheet is displaced toward the second window portion 31R3 in the front-back direction (first direction) or if the sheet is displaced toward the second window portion 31R3 in the lateral direction (second direction, direction perpendicular to the plane of FIG. 7B), the displacement of the sheet is reliably confirmed at the second window portion 31R3.

Note that if the sheet is displaced toward the first window portion 31R2 in the front-back direction (first direction), the bend of the sheet P1 is easily visually confirmed at the first window portion 31R2. Further, if the sheet is displaced toward the third window portion 31L2 and the fourth window portion 31L3 in the lateral direction, the bend of the sheet P2 is reliably visually confirmed at the third window portion 31L2 and the fourth window portion 31L3.

As just described, in this embodiment, the first and second window portions 31R2, 31R3 have a function of exposing opposite end parts (areas of the right end edge including corner parts PT1, PT2 (FIG. 6A) of the sheet) of the right end edge (first side edge PS1) of the sheet (P1, P2) held in contact with the lift plate 310 out of the sheet bundle PS to the outside of the deck tray 31. Note that the second window portion 31R3 exposes the corner part PT2 on a side opposite to the corner part PT1 of the sheet exposed by the first window portion 31R2. Similarly, the third and fourth window portions 31L2, 31L3 have a function of exposing opposite end parts (areas of the left end edge including corner parts of the sheet) of the left end edge (first side edge PS1) of the sheet (P1, P2) held in contact with the lift plate 310 to the outside of the deck tray 31.

In other words, in this embodiment, the forth window 31L3 and the second window portion 31R3 are opens for allowing an inner part of the deck tray 31 to be visible from outside of the deck tray 31 and for exposing one end of the first side edges PS1 of the sheets in the first direction and an one area of the inner part outer than the one end in the first direction to the outside of deck tray 31. Further, the third window 31L2 and the first window portion 31R2 are opens for allowing an inner part of the deck tray 31 to be visible from the outside of the deck tray 31 and for exposing the other end of the first side edges PS1 opposite to the one end of the sheets in the first direction and the other area of the inner part outer than the other end in the first direction to the outside of the deck tray 31.

Further, in this embodiment, each of the first, second, third and fourth window portions 31R2, 31R3, 31L2 and 31L3 is a long and narrow opening formed to include the lowermost position (FIG. 4) of the lift plate 310 and extend in a stacking direction of the sheets P. Particularly, in this embodiment, each window portion extends to a position above the lower end edges of the left and right cut portions 31L1, 31R1. Thus, even if a plurality of sheet bundles PS are successively accommodated into the deck tray 31, the displacement of the sheet P located at the lower end of each sheet bundle PS can be visually confirmed at each window portion.

Further, as described above, if the lift plate 310 is arranged below the lower end edges of the left and right cut portions 31L1, 31R1 when the sheet bundle PS is accommodated into the deck tray 31, the user often supplies the sheet bundle PS while letting it fall. In this embodiment, even if the sheet P located at the lower end of the sheet bundle PS is displaced according to such a fall, the displacement of the sheet can be visually confirmed through each window portion.

Further, in this embodiment, when the sheet bundle PS is accommodated into the deck tray 31, the lift plate 310 is exposed to the outside of the deck tray 31 through the first and second window portions 31R2, 31R3 due to the balancing of the self-weight of the sheet bundle PS and the biasing force of the biasing spring 310S. Thus, the displacement of the sheet P can be quickly confirmed when the sheet bundle PS is supplied.

The sheet stacking device 3 and the image forming apparatus 1 according to the embodiment of the present disclosure are described above. According to such a configuration, a sheet jam can be prevented by adjusting the position of the sheet P when the number of the remaining sheets becomes small. As a result, the sheet P is stably fed to the image forming unit 120 by the sheet discharging unit 3S.

Further, in other words about the sheet stacking device, the sheet stacking device 3 includes the deck tray 31, a pair of first wall portions 31R, 31L, a pair of second wall portions 31F, 31V and the lift plate 310. The sheet stacking device 3 has an open upper surface part and enables a sheet bundle PS to be accommodated therein through the upper surface part. The sheet bundle PS has a pair of first sheet side surfaces extending in a first direction and a pair of second sheet side surfaces extending in a second direction perpendicular to the first direction. The pair of first wall portions stands to face the pair of the first sheet side surfaces of the sheet bundle PS. The pair of second wall portions stands to face the pair of the second sheet side surfaces of the sheet bundle PS. The lift plate 310 is arranged in the deck tray 31 and is configured such that the sheet bundle PS is to be placed on an upper surface. Each of the pair of first wall portions includes a first observation port (31L3, 31R3) for exposing a part of the first sheet side surface and an area between an end part of the first sheet side surface in the first direction and the second wall portion 31V to the outside of the deck tray 31.

However, the present disclosure is not limited to this and can be, for example, modified as follows.

(1) Although each of the right and left frames 31R, 31L is provided with two window portions on front and rear sides in the above embodiment, the present disclosure is not limited to this. The window portion (opening) may be arranged on one end side of each of the right and left frames 31R, 31L in the front-back direction. Further, the window portion(s) may be open only on one of the right and left frames 31R, 31L. Further, these window portions are not limited to such a mode to expose the sheet (P1, P2) held in contact with the lift plate 31 out of the sheet bundle PS. An area in the stacking direction of the sheets P where the sheets P are particularly easily bent may be exposed.

(2) Further, although the lift plate 31 is vertically movable while being kept in a posture extending in the horizontal direction in the above embodiment, the present disclosure is not limited to this. The lift plate 310 may be inclined to move the leading edge (downstream side in the sheet conveying direction) of the sheet bundle PS upwardly.

(3) Further, although the first, second, third and fourth window portions 31R2, 31R3, 31L2 and 31L3 are formed only of the openings in the above embodiment, the present disclosure is not limited to this. A transparent glass (transparent member) may be fitted in each window portion (see transparent glass 31R4 of FIG. 7B). In this case, the entrance of external matters into the interior of the deck tray 31 through each window portion is prevented.

Figure 8:
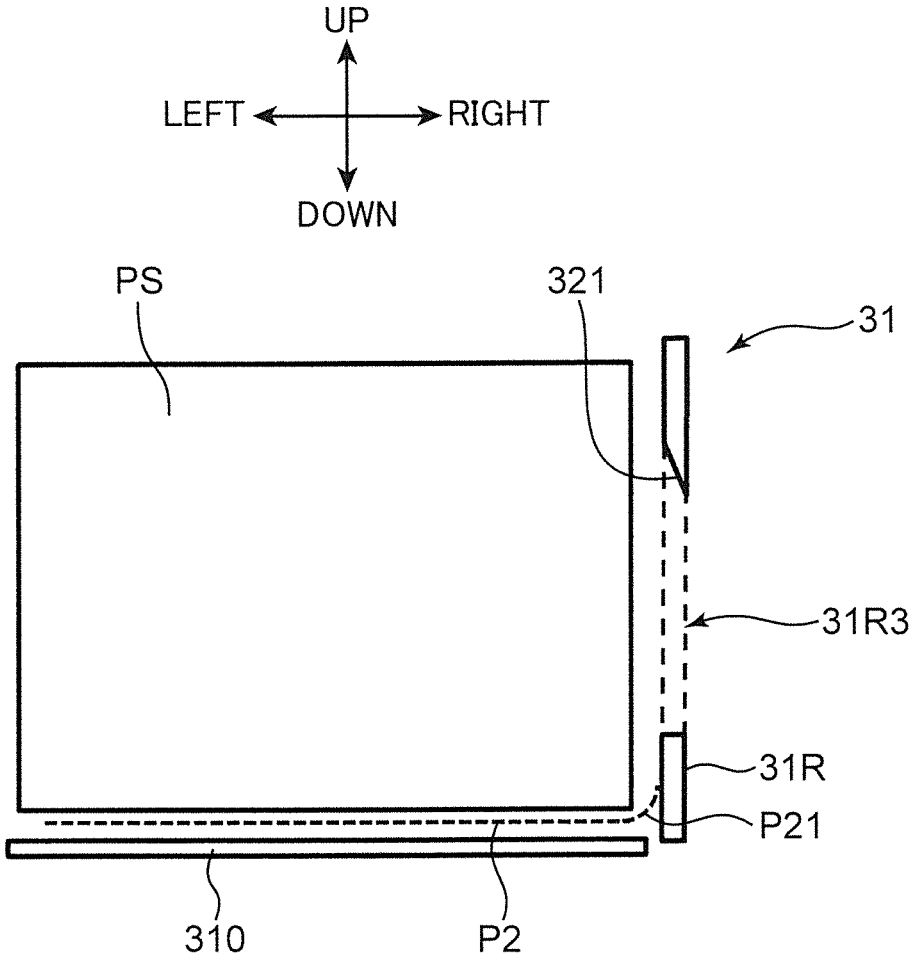
FIG. 8 is a schematic sectional view showing a sheet accommodating unit according to a modification of the present disclosure.

(4) Although each window portion is open to penetrate through the right frame 31R or the left frame 31L along the lateral direction in the above embodiment, the present disclosure is not limited to this. FIG. 8 is a sectional view showing a second window portion 31R3 according to a modification of the present disclosure. In this modification, the second window portion 31R3 is cut such that an upper end part thereof has a tapered surface 321. By providing the tapered surface 321 inclined from the outer side toward the inner side of the deck tray 31 along the sheet stacking direction (upward direction) in this way, an end edge P21 of a sheet P2 enters the inside of the deck tray 31 along the tapered surface 321 even if the end edge P21 protrudes outwardly from the second window portion 31R3. Thus, the sheet P2 can be smoothly supplied to the upper end part of the deck tray 31.

Figure 9A:
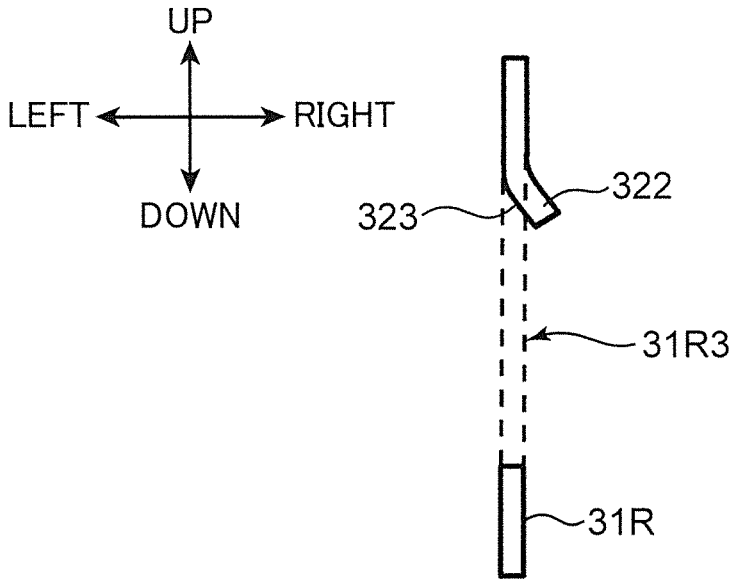
FIG. 9A is a schematic sectional view showing a first observation port of a sheet accommodating unit according to a modification of the present disclosure.
Figure 9B:
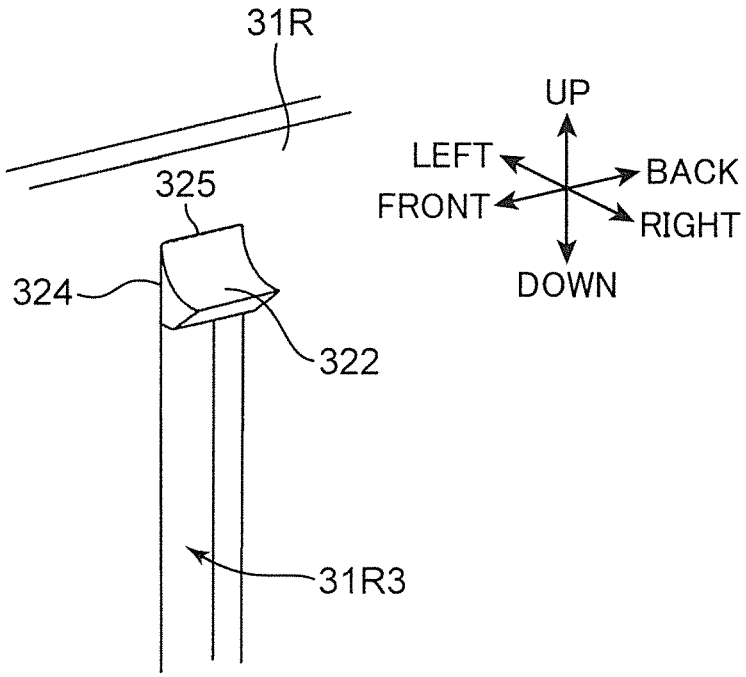
FIG. 9B is a perspective view showing a part of the first observation port of FIG. 9A.

Further, FIG. 9A and FIG. 9B are a sectional view and a perspective view showing a second window portion 31R3 according to another modification of the present disclosure. In this modification, a pair of cuts 324 are formed on the right frame 31R and a curved portion 322 is formed by bending a part between the cuts 324 with a supporting point portion 325 as a supporting point. Also in such a configuration, a tapered surface 323 of the curved portion 322 can exhibit an effect similar to that of the above tapered surface 321. Further, a jam of the sheet P2 is prevented by easy processing (bending) applied to the right frame 31R.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet stacking device, comprising:

a sheet accommodating unit having a substantially rectangular parallelpipedic box shape with an open top and a bottom part opposite the open top, the sheet accommodating unit accommodating a sheet bundle of stacked sheets therein through the open top; and a loading plate arranged horizontally in the sheet accommodating unit and having an upper surface, the loading plate being configured such that the sheets are to be placed on the upper surface of the loading plate, the loading plate having first and second side edges extending in a first direction and first and second end edges perpendicular to the first direction, the loading plate being vertically movable in a predetermined moving range from a lowermost position where the loading plate is in proximity to the bottom part of the sheet accommodating unit to an uppermost position where the loading plate is spaced farther above the bottom part of the sheet accommodating unit; wherein the sheet accommodating unit including:

first and second side walls standing to face the respective first and second side edges of the loading plate;

first and second end walls standing to face the respective first and second end edges of the loading plate;

a first regulating portion standing at a first regulating position inward of the first end wall by a predetermined distance in the first direction, the first regulating position being a position to regulate a movement of the sheet bundle in the first direction; and a first observation port formed on at least one of the side walls and configured to allow an inner part of the sheet accommodating unit to be visible from outside of the sheet accommodating unit, the first observation port being arranged at a position in the first direction spaced inward from end portions of the respective side wall to expose the first regulating position to the outside of the sheet accommodating unit, a lowermost edge of the first observation port being disposed lower than the loading plate and between the loading plate and the bottom part of the sheet accommodating unit when the loading plate is in the lowermost position in the predetermined moving range.

2. A sheet stacking device according to claim 1, wherein the sheet accommodating unit further includes:

a second regulating portion standing at a second regulating position inward of the second end wall by a predetermined distance in the first direction, the second regulating position being a position to regulate a movement of the sheet bundle in the first direction together with the first regulating position; and a second observation port formed on at least one of the side walls and configured to allow an inner part of the sheet accommodating unit to be visible from the outside of the sheet accommodating unit, the second observation port being arranged at a position in the first direction spaced from a corner where the respective side wall and the second end wall meet each other to expose the second regulating portion to the outside of the sheet accommodating unit, a lowermost edge of the second observation port being disposed lower than the loading plate and between the loading plate and the bottom part of the sheet accommodating unit when the loading plate is in the lowermost position in the predetermined moving range.

3. A sheet stacking device according to claim 2, wherein:

each of the first and second observation ports has an elongate shape extending in a stacking direction of the sheets.

4. A sheet stacking device according to claim 1, wherein:

each of the side walls includes an upper end edge extending in the first direction and a cut portion cut down from the upper end edge in a central part in the first direction, a lower end edge of each of the cut portions being disposed higher than a lower end portion of the respective side wall; and the upper surface of the loading plate is arranged below the lower end edges of the cut portions when the sheets are accommodated into the sheet accommodating unit.

5. A sheet stacking device according to claim 1, further comprising a spring configured to bias the loading plate upwardly, wherein:

the loading plate is exposed to the outside of the sheet accommodating unit through the first observation ports due to the balancing of a weight of the sheet bundle and a biasing force of the spring when the sheet bundle is accommodated into the sheet accommodating unit.

6. A sheet stacking device according to claim 1, wherein:

a part of the loading plate is exposed to the outside of the sheet accommodating unit through the first observation ports.

7. An image forming apparatus, comprising:

a sheet stacking device according to claim 1;

a feeding unit configured to feed the sheet accommodated in the sheet accommodating unit; and an image forming unit configured to form an image on the sheet fed by the feeding unit.

8. A sheet stacking device according to claim 1, wherein the first side wall has opposite inner and outer surfaces, the inner surface of the first side wall facing toward the loading plate and the outer surface facing away from the loading plate, the first observation port has an upper end part formed with a tapered surface inclined down from the inner surface toward the outer surface of the first side wall.

9. A sheet deck comprising:

a main body;

a sheet discharging unit for feeding the sheets in a feeding direction along the second direction, and the sheet stacking device of claim 1, wherein the sheet stacking device is configured relative to the main body to be pulled out from the main body in the first direction.

10. A sheet stacking device, comprising:

a sheet accommodating unit having a substantially rectangular parallelpipedic box shape with an open top and a bottom part opposite the open top, the sheet accommodating unit accommodating a sheet bundle of stacked sheets therein through the open top; and a loading plate arranged horizontally in the sheet accommodating unit and having an upper surface, the loading plate being configured such that the sheets are to be placed on the upper surface of the loading plate, the loading plate having first and second side edges extending in a first direction and first and second end edges perpendicular to the first direction, the loading plate being vertically movable; wherein the sheet accommodating unit including:

first and second side walls standing to face the respective first and second side edges of the loading plate;

first and second end walls standing to face the respective first and second end edges of the loading plate;

a first regulating portion standing at a first regulating position inward of the first end wall by a predetermined distance in the first direction, the first regulating position being a position to regulate a movement of the sheet bundle in the first direction; and a first observation port formed in the first side walls and configured to allow an inner part of the sheet accommodating unit to be visible from outside of the sheet accommodating unit, the first observation port being arranged at a position in the first direction spaced inward from end portions of the first side wall to expose the first regulating position to the outside of the sheet accommodating unit;

at least the first side wall includes an upper end edge extending in the first direction and a cut portion cut down from the upper end edge in a central part of the first side wall in the first direction, a lower end edge of the cut portion being disposed higher than a lower end portion of the first side wall;

the sheet stacking device further comprising first and second rail portions attached respectively to the first and second side walls, the first rail portion being disposed between the lower end edge of the cut portion and the lower end portion of the first side wall in the up-down direction and extending horizontally, the first and second rail portions being configured to make the sheet accommodating unit move slidably relative to a main body; and a lowermost edge of the first observation port being disposed lower than the first rail so that the first observation port exposes the first regulating portion to the outside of the sheet accommodating unit at a position under the first rail portion.

* * * * *